US005660391A

United States Patent [19]

Klasee

[11] Patent Number: 5,660,391

[45] Date of Patent: Aug. 26, 1997

[54] BLACKJACK CARD GAME METHOD OF PLAY

[76] Inventor: Evan Neil Klasee, 2933 Cassia St., Newport Beach, Calif. 92660

[21] Appl. No.: 664,154

[22] Filed: Jun. 14, 1996

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS

| | | | |
|---|---|---|---|
| 4,861,041 | 8/1989 | Jones et al. | 273/292 |
| 5,174,579 | 12/1992 | Griffiths | 273/292 |
| 5,288,077 | 2/1994 | Jones | 273/292 |
| 5,364,105 | 11/1994 | Jones | 273/292 |
| 5,452,899 | 9/1995 | Skratulia et al. | 273/292 |
| 5,452,900 | 9/1995 | Skratulia et al. | 273/292 |
| 5,529,309 | 6/1996 | Bartlett | 273/292 |

OTHER PUBLICATIONS

"Over/Under 13 Blackjack", Gaming Concepts, Inc., 1988.

*Primary Examiner*—Benjamin H. Layno
*Attorney, Agent, or Firm*—Quirk & Tratos

[57] ABSTRACT

A new card game is set forth where a player wagers that a hand to be assembled in the round of play will be a Blackjack, 21, 20, 19 or 18. Four playing cards are selected and exposed from which the best ranking blackjack hand is assembled. If the assembled hand matches the player's wager, wager is won. If it does not match, the wager is lost.

15 Claims, 1 Drawing Sheet

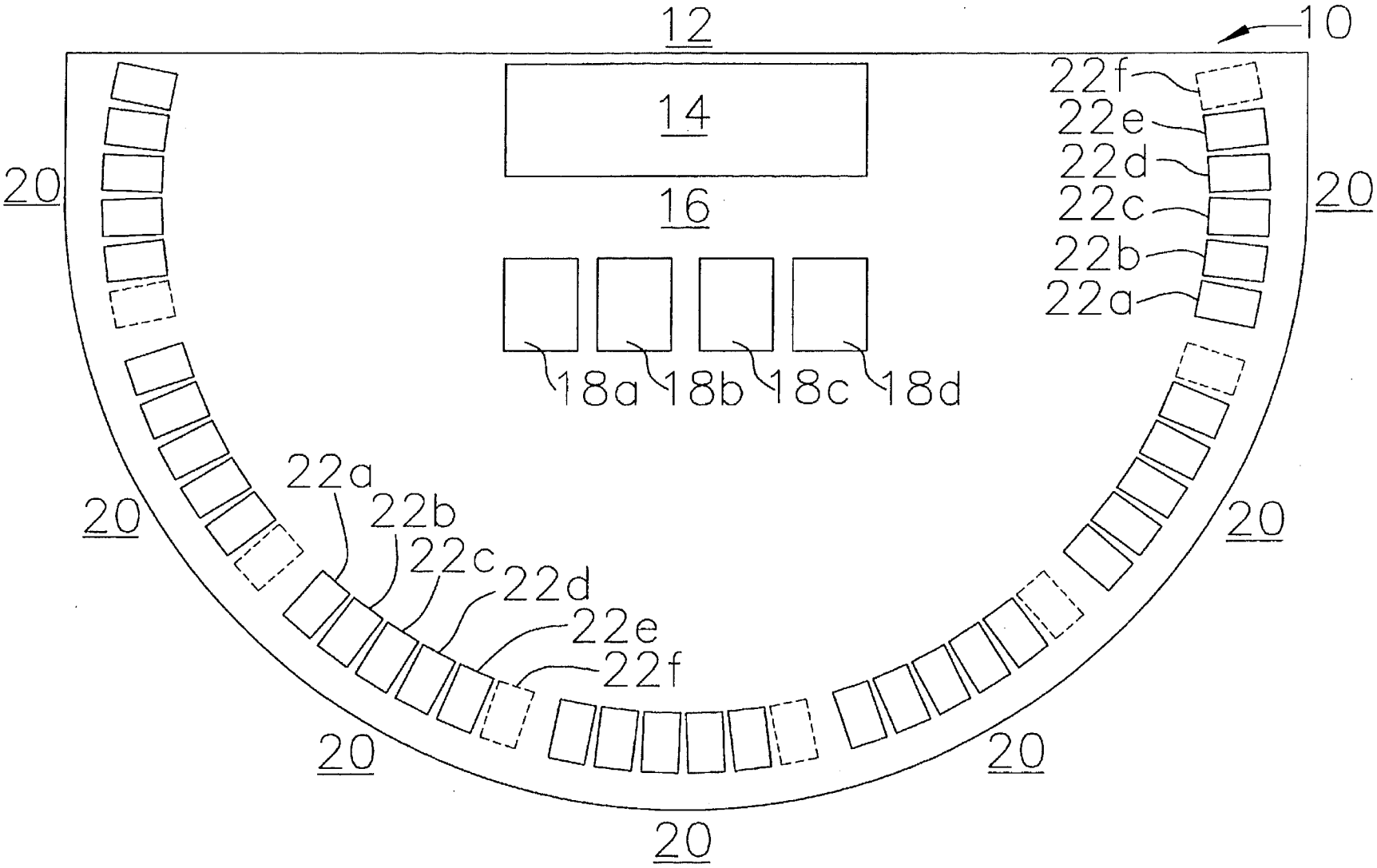
10
12
14
16
18a
18b
18c
18d
20
22a
22b
22c
22d
22e
22f

BLACKJACK CARD GAME METHOD OF PLAY

FIELD OF THE INVENTION

This invention relates to card games whether played with actual playing cards or processor generated representations of playing cards. More particularly, it relates to a card game adapted for casino gaming.

BACKGROUND OF THE INVENTION

Card games are widely known and are played by persons for entertainment as well as in a gaming environment such as, at a casino. For example, blackjack is one of the more popular card games. In modern casinos, numerous blackjack tables can be found. Blackjack appeals to the public in that, the casino or "house", does not have a great statistical advantage in the game, and the rules of play are simple, straight forward and easily understood.

Some players or potential players may be somewhat intimidated by the game of Blackjack for one or more reasons. For example, the decision of when to stand or take a card in an effort to best the dealer's hand can cause anxiety, particularly when such decisions must be frequently made. Second, many players feel a sense of allegiance to the other players at the table. Knowing that the decision of whether to take an additional card or stand can effect the success of other players is another source of anxiety. For example, a player who repeatedly takes a card in circumstances where he/she should stand, can draw adverse reactions from the other players and generate a feeling that the player making the mistake has let the other players down. A specific example would be, where the dealer has an exposed card which is a 6 with a face down card suggesting that the dealer may have an initial hand of 16 and be susceptible to "busting", i.e. going over 21. A player, particularly one immediately to the right of the dealer, who opts to take a card when he/she should not, can receive a card which, if it had been taken by the dealer, would cause the dealer to bust. This situation is not only aggravating to the other players, who had played their hand's in anticipation that the dealer would bust, but also draws adverse reactions from the players and embarrassment to the player who made the mistake.

Another concern directed to Blackjack is the potential for cheating. A dealer may work in concert with a collaborating player. In those circumstances, where the dealer can examine his down, or unexposed, card, the dealer may be able to signal his collaborator altering the statistical advantage of the house in favor of the player.

There is, therefore, a need for a card game which can be played live or electronically which is simple, easy, and less intimidating. There is also a need for a game having the aforemention attributes which is suitable for casino-type gaming and is adapted to lessen the opportunities for cheating. To satisfy such needs, it is further desirable that any new game have familiar rules to attract players and not require extensive retraining for dealers.

SUMMARY OF THE INVENTION

Accordingly, there is set forth, a card game suitable for live action play using playing cards or played through the use of electronic devices which can simulate playing the game with cards which is easy, fast, has rules familiar to players and dealers, which is less intimidating and which resists the effects of cheating.

Toward this end, a game according to the present invention, is set forth which includes the steps of a player wagering that the outcome of an assembled hand will be a Blackjack, 21, 20, 19, or 18. After the player makes the wager, four playing cards are selected and exposed either through live action play by a dealer or by representations generated by a suitable processor and video display. From the four exposed cards, a hand is assembled which represents the best hand according to the rules of Blackjack. If the four exposed cards are insufficient to assemble a hand of 18 or better according to the rules of Blackjack, the two lowest cards are discarded and replaced, and from the replacement and original cards, a qualifying ranking is assembled. After a qualified ranking hand is assembled, i.e. a Blackjack, or 18 through 21, the assembled hand is compared to the outcome wagered upon by the player. If the player's wager and the assembled hand agree, e.g. are both 18, the player is declared the winner. In other circumstances, the player is declared the loser. Where the player is declared the winner, his wager is paid at odds depending upon the wagered number, and when the player is declared the loser, his wager is collected.

In a further embodiment of the game, according to the present invention, the player at the outset may also opt to wager that the assembled hand will be less than 18. According to this version of the game, the best hand, according to the rules of Blackjack, is assembled from the initial four cards regardless of whether or not the hand has a ranking of 18 or better. If the player has made the appropriate wager and if the assembled hand agrees, the player is declared the winner of this wager and is paid at odds of, for example, 15:1.

As can be appreciated, the game, according to the present invention, is fast in that the dealer need not deal individual hands to each player. Further, the game is less intimidating in that the players have no choices in regards to the selection of the cards and each player's action, which consists of selecting which bet to make, does not effect the success or failure of other players. The game is additionally simple to play in that the rules for ranking of the hands is the same as in Blackjack, a game familiar to both players and dealers. The opportunity to cheat is also reduced in that the players have no opportunity to collaborate with the dealer since the play of the assembled is out of the control of the players. Still further, and to the advantage of the house or casino, there are no ties in that each hand results in a win or loss for each player, further contributing to the fast pace of the game and the revenues received.

BRIEF DESCRIPTION OF THE DRAWING

These and other features and advantages will become appreciated as the same becomes better understood with reference to the specification, claims and drawing which depicts a layout for play of the game.

DETAILED DESCRIPTION OF THE PREFERRED EMBODIMENT

With reference to the drawing, a layout 10, which can be used to play the game, is illustrated. Typically, the layout 10 is sized to fit a normal Blackjack table used in live action Blackjack games at a casino. The layout 10 may be fashioned from colored felt or the like.

The layout 10 is arcuate having a linear side, a portion of which defines a dealer position 12 where a dealer stands during normal play of the game. Typically the dealer is employee of the casino or "house". Proximate the dealer position 12, tray 14, is adapted, as is common with Blackjack tables, to hold tokens used in the play of the game. These tokens are received by players in exchange for legal tender or a marker and typically have denominations of five dollars, twenty-five dollars, one-hundred dollars or five-hundred dollars. Cash can also be used in wagering for the game. In those situations where the game is played purely for entertainment purposes and in a non-gaming environment, tokens such as chips or the like will be provided to the players free of charge.

In front of the tray 14 is an action area 16 where playing cards are dealt by the dealer for the play of the game. The action area 16 may include four spots 18*a–d*, shown as being rectangular, to receive the cards in the manner described below. In the play of the game, the dealer deals either from a single deck of playing cards or a shoe containing multiple decks and places the selected cards in the spots 18 *a–d*.

Spaced about the arcuate parameter of the layout 10 are seven player positions 20, each occupied by an individual player or left vacant, depending upon the number of players for the game. Each player position 20 may be suitably delineated with logo or other indicia to identify each player with their respective player position 20.

Each player position 20 has associated therewith discrete betting areas 22*a–e*. These wagering areas 22*a–e* may be indicated by squares, as shown in the drawing, circles, written indicia, or other representations sufficient to identify a particular wager with a discrete area. To also identify each wagering area 22*a–e*, a suitable description may be provided therewith. According to the preferred embodiment of the game, wagering area 22*a* has a written description of "Blackjack" or "BJ" associated therewith to indicate that this is the Blackjack wagering area 22*a*. Wagering area 22*b* has a description "21" provided in association therewith as by being included within the bounds of the wagering area 22*b*. Wagering areas 22*c–e* have associated therewith descriptions of "20", "19", "18", respectively, as by including these numerical descriptions within the bounds of the appropriate wagering areas. Alternatively, each of the wagering areas 22*a–e* could include a number reference such as 1 through 5, respectively, and a common description could be provided on the layout 10 to associate wagering area 1 with a Blackjack, 2 with a 21, 3 with a 20, 4 with a 19, and 5 with an 18.

Any player wishing to enter the game does so by making a wager or wagers in a selecting wagering area(s). By making a wager, the player is attempting to predict that a certain hand will be assembled during this particular round of play. For example, a player may anticipate or have a hunch that the hand assembled, according to the rules of the game hereinafter described, will be 20. Accordingly, the player places his/her wager by means of locating one or more betting tokens (or cash) in the wagering area 22*c* which, as described above, associates the wager with 20. The player may also wish to wager, in the same hand, on other numbers. The amount of the wager(s) made by the player may be dictated by table minimums or maximums. After each player wishing to enter the round of play has placed their bets in the selected and appropriate wagering areas 22*a–e*, four cards are dealt by the dealer into the action area 16 as by locating them in spots 18*a–d*. The dealer turns these four cards over and they are exposed for the player to see. Alternatively, the dealer could evenly distribute the deck into four substantially even piles face down, each pile in a spot 18*a–d* and turn over the top card of each pile.

From the four exposed cards, the dealer assembles the highest ranking Blackjack hand possible using two or all four of the cards. If two hands of equal ranking can be assembled, e.g. two 18*s*, only one assembled hand of 18, selected at the dealer's discretion, is used. The assembled hand, according to the rules of Blackjack, cannot exceed 21, aces count as 1 or 11 and face-cards (Kings, Queens and Jacks) count as 10. All other cards have there assigned face values.

As stated above, the four exposed cards in the action area 16 are assembled into the best Blackjack according to the following ranking:

1. Ace with any 10 or face card (a Blackjack),
2. Any hand where the sum of any three or more cards is 21,
3. Any hand where the sum of any two or more cards is 20,
4. Any hand where the sum of any two or more cards is 19, and
5. Any hand where the sum of any two or more cards is 18.

If the four exposed cards in the action area 16 cannot be assembled into any hand having a ranking of 18 or above, the dealer discards the two lowest exposed cards of the four and deals and exposes (or turns over) two replacement cards in the action area 16. The dealer then, from this revised field of four exposed cards assembles the best Blackjack hand of 18 or better therefrom. The discarding and replacement described above continues until the dealer can assemble a qualifying ranking hand of 18 or better.

For example, if the four cards dealt and exposed are: Ace, 7, 3, and 9, the highest ranking hand would be a three card 21 assembled from the Ace, 7, and 3. If the four cards dealt and exposed are: 2, 3, 7, and 9, all four cards would be used to assemble a hand of 21. If the four cards dealt and exposed are: King, 2, 5, and 10, the assembled hand would be a two card 20 represented by the King and 10.

The assembled, qualifying ranking hand, is segregated from the remainder of the four cards, if any, for the players to confirm that the highest ranking hand has been formed. The cards not used to assemble the combination remain exposed land in their original spots 18*a–d*.

After the dealer has assembled and segregated the qualifying ranking hand, the hand is compared to the wagers made by each player. If the assembled hand and the wagered hand have the same ranking without regard to suit, the player is declared to have won the wager. For example, where the player has wagered on a 20 by placing a token in wagering area 22*c* and the highest ranking assembled hand is likewise a 20, the player is declared to have won the wager. If the assembled hand is different in value or ranking from the wagered anticipated outcome, the player is declared to have lost the wager.

In live casino action, in those instances when the player is declared to have won, the dealer pays the player based upon the number wagered upon. Table 1 below sets forth the pay out schedule which may be used for declared winners.

TABLE 1

| # WAGERED UPON | PAY OUT |
|---|---|
| Blackjack | 5:1 |
| 21 | 2:1 |
| 20 | 1:1 (even money) |
| 19 | 5:1 |
| 18 | 15:1 |

Of course other pay outs could be adjusted to alter the advantage to the player or casino.

In those instances when the player is declared to have lost the wager, the player's wager is collected by the dealer and the player's wagering token is placed in the tray 14.

After the wagers are paid or collected, the cards used in the assembled hand are discarded. New cards are dealt and exposed or, if piles are used, turned over to, in combination with any remaining exposed cards of the previous hand, define a field of four cards from which to assemble the next hand. If the exposed, unused cards can be assembled into a qualifying hand, they too are discarded. For example, the four cards are King, Queen, 10 and 9, the dealer would assemble a qualify hand of 20 using at his/her discretion, the King and Queen or either of them with the 10. Thus the unused cards, for example 10 and 9, since they represent a qualifying hand, would be discarded with the assembled hand and four new cards are exposed. In this fashion, the players do not have the advantage of wagering after a winning combination is already exposed. The players make new wagers for the next round of play. Play continues as described above for succeeded rounds of play.

As a further embodiment, players may be able to place a wager in anticipation that the assembled hand from the four cards dealt and exposed will be less than 18 by placing a wager in a wagering area 22*f*. According to this version of the game, four cards are dealt and exposed (or turned over from the piles) as described above. From those four cards, the dealer, also as before, assembles the highest ranking Blackjack hand. Regardless of whether or not a qualified ranking hand of 18 or better can be assembled, no cards are discarded or replaced. For example, if the four exposed cards are: 2, 2, 6, and 6, the assembled hand would be a four card 16.

After assembly of the highest ranking Blackjack hand is made from the four exposed cards dealt and the dealer has segregated the assembled hand for the players to verify, the player's wagers are resolved as before. However, where the assembled hand is less than 18, those players having placed wagers in wagering areas 22*f*, anticipating that the assembled hand would be less than 18, are declared to have won their wagers and are paid at, for example, 15:1. These odds may be adjusted to alter the advantage to the player or casino. Those having placed other wagers are declared to have lost. After wagers have been paid or collected, the cards used to assemble the ranking hand are discarded and a new round of play begins. According to this embodiment, play of the game need not be slowed by the dealer discarding and replacing cards when attempting to assemble a ranking hand.

While the cards may be reshuffled at any time during play, for single deck play, the deck should be reshuffled no later than after ten hands.

While I have described the play of the game in the context of a live action casino game, it is to be understood that the game could also be played through the use of computer generated images on a video display of playing cards retrieved from a data structure representing a deck of cards. A player would make a wager, as recited above, and the computer would be initiated to retrieve from the data structure, at random, signals representative of four cards, display those selected cards, and assemble the hand in a video format for the round. A player making the wager which matches the assembled hand would be declared the winner and a player not having made the appropriate wager is declared the loser. Winning wagers are paid according to the description of the live action game described above and the losing wagers are retained, i.e. collected. After the wager has been paid, at odds described above, or collected, a new wager is placed and the processor is initiated for the next round of play. In this fashion, the game can be embodied in a video format to be played by one or more players.

It is further to be understood that the game can be embodied in a non-gaming environment such as a game played purely for entertainment value using free tokens or other "stakes", i.e. match sticks. The game could also be embodied in a portable or hand held electronic device, and again played purely for entertainment purposes. Imaginary or electronically depicted wagers would be made, paid and collected according to the various embodiments described above.

While I have shown and described certain preferred embodiments of the present invention, it is to be understood that it is subject to many modifications without departing from the spirit and scope of the claims.

I claim:

1. A method for playing a Blackjack card game comprising the steps of:

(i) providing at least one standard 52-card deck;

(ii) assigning each of the Aces a point value of 1 or 11, assigning each of the numbered cards two-ten their numerical face value and assigning each of the Jacks, Queens and Kings a point value of 10;

(iii) providing a plurality of separate wagering options to a player, the plurality of wagering options include that the outcome of an assembled hand is a Blackjack, 21, 20, 19, 18 or less than 18;

(iv) a player selecting at least one wagering option;

(v) selecting and exposing four cards;

(vi) from the four exposed cards, assembling a hand by adding together the numerical values of any two or more of the four exposed cards which represents the best hand according to the rules of Blackjack; and (vi) comparing the outcome wagered upon by the player to the assembled hand, the player's wager won if the assembled hand and the wagered outcome agree and the players wager lost if the wagered outcome and the assembled hand do not agree.

2. The game of claim 1 wherein the player's wagers is representative of money and winning wagers are paid at least at odds of 1:1.

3. The game of claim 2 wherein the player's wager is paid at least 2 to 1 if the wagered outcome and the assembled hand agree and the assembled hand is a Blackjack.

4. The game of claim 2 wherein the wagers are paid at odds depending upon the number wagered upon and are approximately, for less than 18, 15 to 1, for 18, 15 to 1, for 19, 5 to 1, for 20, 1 to 1, for 21, 2 to 1 and for Blackjack, 5 to 1.

5. The game of claim 1 further including a dealer dealing and exposing said four playing cards and from said exposed cards assembling said hand.

6. The game of claim 5 wherein the dealer deals the playing cards into four piles, exposes the top card of each pile and assembles the dealer hand from said exposed cards.

7. The game of claim 5 further including a representation of a playing surface having depicted thereon wagering areas for each outcome selected by the player to be wagered upon, the game further including the player making any selected outcome wager by so indicating in the corresponding designated wagering area.

8. A method for playing a Blackjack card game comprising the steps of:

(i) providing at least one standard 52-card deck;

(ii) assigning each of the Aces a point value of 1 or 11, assigning each of the numbered cards two-ten their numerical face value and assigning each of the Jacks, Queens and Kings a point value of 10;

(iii) providing a plurality of separate wagering options to a player, the plurality of wagering options include that the outcome of an assembled hand is a Blackjack, 21, 20, 19, or 18;

(iv) a player selecting at least one wagering option;

(v) selecting and exposing four cards;

(vi) from the four exposed cards, assembling a hand by adding together the numerical values of any two or more of the four exposed cards which represents the best hand according to the rules of Blackjack;

(vii) if a hand of 18 or better cannot be assembled, discarding the two lowest exposed cards and selecting and exposing two replacement cards and assembling the best Blackjack hand therefrom, a hand of 18 or better representing the final hand; and (viii) comparing the outcome wagered upon by the player to the final hand, the player's wager won if the final hand and the wagered outcome agree and the players wager lost if the wagered outcome and the final hand do not agree.

9. The method of claim 8 wherein the player's wager is representative of money and further including paying a player's wager at least at even money when the player is declared a winner.

10. The method of claim 9 further including paying the player's wager at least at odds of 2 to 1 if the wagered outcome and the assembled hand agree and the assembled hand is a Blackjack.

11. The method of claim 9 including paying players declared winners at odds depending upon the number of the winning wager of approximately, for 18, 15 to 1, for 19, 5 to 1, for 20, 1 to 1, for 21, 2 to 1 and for a Blackjack, 5 to 1.

12. The method of claim 9 wherein the game is played with playing cards, the method further including a dealer dealing and exposing said four playing cards and from said exposed cards assembling said hand.

13. The method of claim 12 wherein the dealer deals the playing cards into four piles, exposes the top card of each pile and assembles the dealer hand from said exposed cards.

14. The method of claim 12 further including a representation of playing surface having depicted thereon wagering areas for each outcome selected by the player to be wagered upon, the method further including the player making any selected outcome wager by so indicating in the corresponding designated wagering area.

15. A method for playing a Blackjack card game between a dealer and a player comprising the steps of:

(i) providing at least one standard 52-card deck;

(ii) assigning each of the Aces a point value of 1 or 11, assigning each of the numbered cards two-ten their numerical face value and assigning each of the Jacks, Queens and Kings a point value of 10;

(iii) providing a plurality of separate wagering options to a player, the plurality of wagering options include that the outcome of an assembled hand is a Blackjack, 21, 20, 19, or 18;

(iv) a player selecting at least one wagering option;

(v) the dealer selecting and exposing four cards;

(vi) from the four exposed cards, the dealer assembling a hand by adding together the numerical values of any two or more of the four exposed cards which represents the best hand according to the rules of Blackjack;

(vii) if a hand of 18 or better cannot be assembled, the dealer discarding the two lowest exposed cards and selecting and exposing two replacement cards and assembling the best Blackjack hand therefrom, a hand of 18 or better representing the final hand; and (viii) comparing the outcome wagered upon by the player to the final hand, the player's wager won if the final hand and the wagered outcome agree and the players wager lost if the wagered outcome and the final hand do not agree.

* * * * *